United States Patent [19]

Kono

[11] Patent Number: 4,488,706

[45] Date of Patent: Dec. 18, 1984

[54] MANHOLE COVER LIFTING HOOK

[76] Inventor: Kazuhiko Kono, No. 40, Kotakecho, 2-chome, Nerima-ku, Tokyo 176, Japan

[21] Appl. No.: 619,696

[22] Filed: Jun. 13, 1984

Related U.S. Application Data

[63] Continuation of Ser. No. 477,274, Mar. 21, 1983, abandoned.

[30] Foreign Application Priority Data

Apr. 1, 1982 [JP] Japan ..... 57-52305

[51] Int. Cl.[3] ..... B66F 3/00

[52] U.S. Cl. ..... 254/131

[58] Field of Search ..... 414/684.3, 494; 254/131, 120, 8 R; 294/17; 269/75, 45

[56] References Cited

U.S. PATENT DOCUMENTS

| | | | |
|---|---|---|---|
| 260,396 | 7/1882 | Hunt | 269/45 |
| 1,192,267 | 7/1916 | Bond | 269/75 |
| 1,907,048 | 5/1933 | Detweiler | 254/131 |
| 2,249,603 | 7/1941 | Elkington | 254/131 |
| 2,420,001 | 5/1947 | McCollum | 254/131 |
| 2,548,944 | 4/1951 | Chapman | 254/133 |
| 2,655,399 | 10/1953 | McMillan | 254/131 |
| 3,198,362 | 8/1965 | Berg | 254/131 |
| 3,275,299 | 9/1966 | Meshew | 254/131 |
| 3,985,338 | 10/1976 | Herrmann | 254/131 |
| 4,039,178 | 8/1977 | Odames | 269/75 |
| 4,070,011 | 1/1978 | Glesser | 269/45 |
| 4,126,297 | 11/1978 | Barnes | 254/131 |
| 4,365,925 | 12/1982 | Girtz | 414/684.3 |

FOREIGN PATENT DOCUMENTS

| | | | |
|---|---|---|---|
| 340466 | 1/1931 | United Kingdom | 269/45 |

*Primary Examiner*—Robert C. Watson

*Attorney, Agent, or Firm*—Flynn, Thiel, Boutell & Tanis

[57] ABSTRACT

A hook for a manhole cover having a hook hole, comprises a lever rod having a load end, at least one roller rotatably mounted on the lever rod and rollingly movable at least in a back-and-forth direction, and a hook mounted on the load end for engaging in the hook hole in the manhole cover. The hook enables the worker to open and close a heavy manhole cover quite easily with a reduced expenditure of physical energy.

2 Claims, 7 Drawing Figures

MANHOLE COVER LIFTING HOOK

This application is a continuation of U.S. Ser. No. 477,274, filed Mar. 21, 1983 now abandoned.

BACKGROUND OF THE INVENTION

The present invention relates to a lever hook for lifting manhole covers.

There has been known a hand-held hook for lifting manhole covers which comprises a rod having on one end a grip and on the other end an engagement portion for engaging a hook hole in a manhole cover. In use, the engagement portion is engaged in the hook hole and the grip is manually gripped and then pulled up to lift the manhole cover. The manhole cover as it is lifted is retracted to open the manhole. To close the manhole, the manhole cover is moved over the manhole by the hook manually held by the worker and then is allowed down to cover the manhole. The worker who uses the prior hand-held lifting hook is required to consume a large amount of physical energy to open and close the manhole cover. One problem with the hand-held lifting hook is that the worker tends to suffer from injuries such as a slipped disk while working. Some heavy manhole covers weigh 250 Kg, and can only be opened and closed by three to four workers.

SUMMARY OF THE INVENTION

It is an object of the present invention to provide a lever hook capable of enabling the worker to open and close manhole covers easily and relatively effortlessly without causing physical harms such as a slipped disk to the worker.

According to the present invention a hook for a manhole cover having a hook hole, comprises a lever rod having a load end, at least one roller rotatably mounted on the lever rod and rollingly movable at least in a back-and-forth direction, and a hook mounted on the load end for engaging in the hook hole in the manhole cover.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
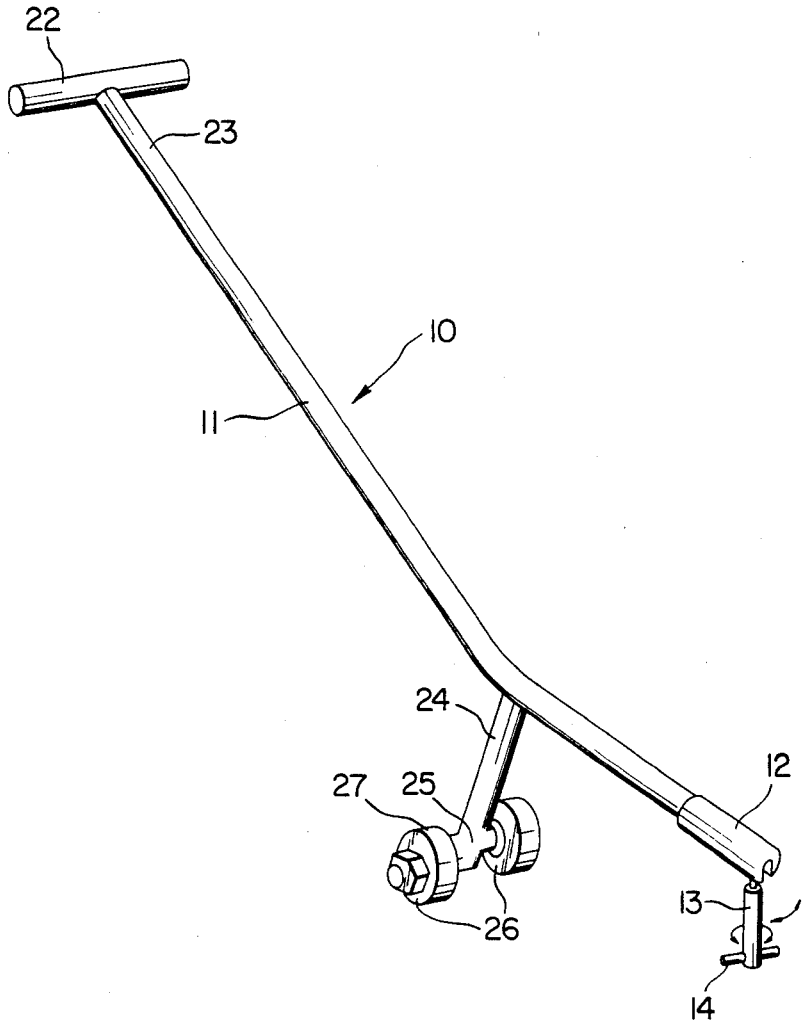
FIG. 1 is a perspective view of a lever hook for lifting manhole covers according to the present invention.

FIG. 1 shows a lever hook 10 according to the present invention for lifting a manhole cover. The lever hook 10 comprises a lever rod 11 having a load end 12 on which is pivotably mounted a cylindrical hook 13 directed downwardly in its free state. The hook 13 is horizontally rotatable about its own axis and also capable of angular movement in the longitudinal direction of the lever rod 11. The hook 13 has a pin 14 extending transversely thereof and having opposite ends projecting laterally from the hook 13.

Figure 2:
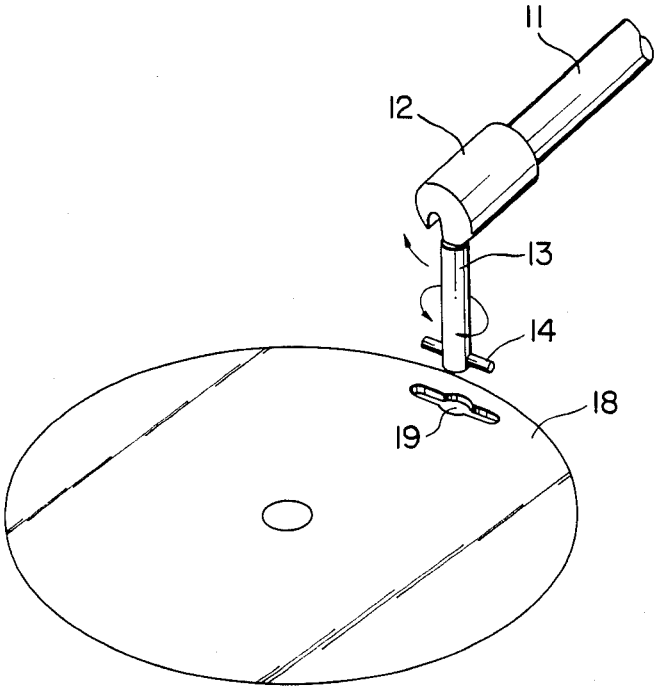
FIGS. 2 and 3 are perspective views of different manhole covers that can be opened and closed by the lever hook of the present invention.
Figure 3:
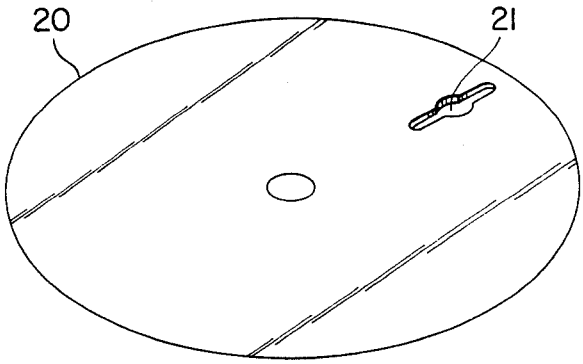

FIG. 2 shows a manhole cover 18 having hook hole 19 elongated in a direction normal to a radial direction of the manhole cover 18. FIG. 3 illustrates a manhole cover 20 having a hook hole 21 elongated in a radial direction of the manhole cover 20. Each of the hook holes 19, 21 has a configuration such that the hook 13 with the pin 14 can fit into the hook hole. The lever hook 10 shown in FIG. 1 can be used with both of the manhole covers 18, 20. In use, the hook 13 is turned about its own axis to bring it and the pin 14 into alignment and fitting engagement with the hook hole 19 or 21, and then is turned again preferably through 90 degrees.

Figure 4:
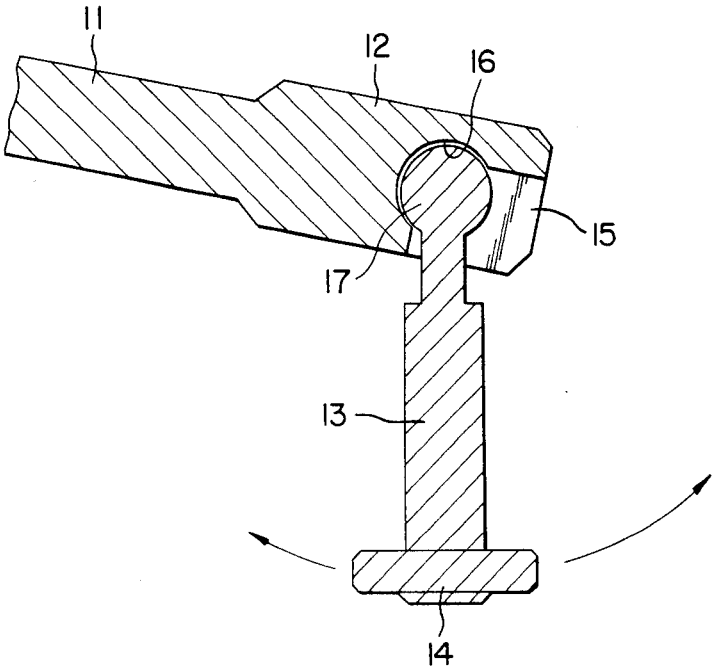
FIG. 4 is an enlarged fragmentary cross-sectional view of the lever hook of the invention.

As shown in FIG. 4, the end 12 of the lever rod 11 has a recess 15 extending longitudinally of the lever rod 11 and a spherical cavity 16 communicating with the recess 15. The hook 13 has a ball 17 remote from the pin 14 and rotatably received in the spherical cavity 16. The ball 17 allows the hook 13 to turn thereabout in the longitudinal direction of the lever rod 11 and also rotate about the axis of the hook 13.

In FIG. 1, the lever rod 11 has on an acting end 23 opposite to the load end 12 a grip 22 extending transversely of the lever rod 11. A support bar 24 extends substantially normally from the lever rod 11 at a position closer to the end 12 than to the end 23, and has a cross bar 25 on which a pair of rollers 26, 26 are rotatably mounted. Each of the rollers 26 has an anti-skid peripheral surface 27 so that the rollers 26 will not slip sideways on the ground surface. Although not shown, the rollers 26 may be replaced with casters or other ball-shaped rollers which are universally movable around. The requirement is that the rollers 26 permit the lever hook 10 to move at least back and forth.

Figure 5:
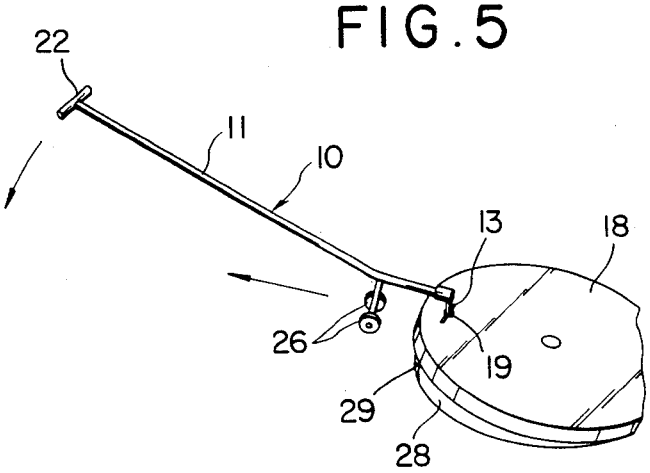
FIG. 5 is a perspective view showing the manner in which the lever hook of the invention is employed to lift a manhole cover.

To open the manhole cover 18, the load end 12 is lowered toward the manhole cover 18 until the hook 13 is engaged in the hook hole 19 as shown in FIG. 5. With the lever rod 11 positioned properly with respect to the manhole cover 18, the grip 22 is gripped by the worker and pushed downwardly to turn the lever rod 11 about the rollers 26. The manhole cover 18 can easily be lifted slightly out of a manhole 28 with a relatively small force. The lever hook 10 is retracted with the rollers 26 rolling to pull the manhole cover 18 sideways until it is frictionally moved over and past an edge 29 around the manhole 28, thereby opening the manhole 28. Since the hook 13 is swingable longitudinally of the lever rod 11, the hook 13 allows smooth angular movement of the lever rod 11 with respect to the hook 13 and the manhole cover 18 while the latter is being lifted and displaced sideways.

When the manhole 28 is to be closed by the manhole cover 18, the lever rod 11 is pushed toward the manhole 28 while the manhole cover 18 is being engaged and slightly lifted by the hook 13 until the manhole cover 18 is moved frictionally on the ground surface and brought over the manhole 28. Thereafter, the grip 22 is allowed up to lower the manhole cover 18 into covering relation to the manhole 28, and then the hook 13 is disengaged out of the hook hole 19.

Figure 6:
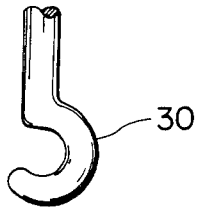
FIG. 6 is an enlarged side elevational view of a lever hook according to another embodiment of the present invention.
Figure 7:
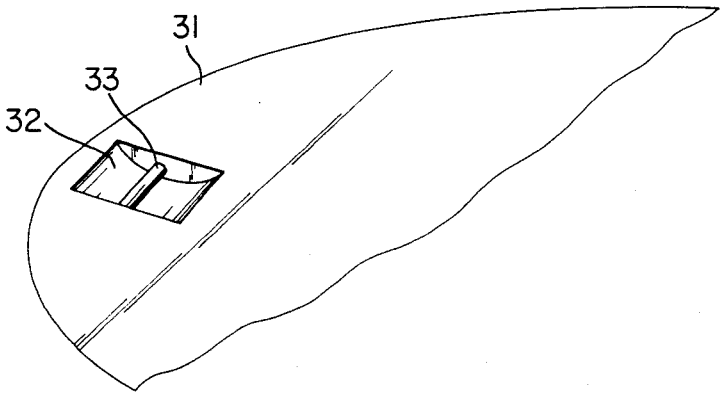
FIG. 7 is a fragmentary perspective view of a manhole cover which can be opened and closed by the lever hook shown in FIG. 6.

FIG. 6 shows a C-shaped hook 30 according to another embodiment of the present invention, the hook 30 being pivotably mounted on the lever rod 11. The hook 30 is particularly usefull in lifting a manhole cover 31 as shown in FIG. 7, which has a slot 32 and a horizontal rod 33 extending across the slot 32. When in use, the hook 30 is placed in the slot 32 to engage the rod 33, and the lever rod 11 is turned to lift the manhole cover 31.

With the manhole cover lifting hook of the present invention, manhole covers can easily and relatively effortlessly be opened and closed without requiring a large expenditure of physical energy on the part of the worker, and hence without the danger for the worker to suffer from injuries such as a slipped disk. The lever hook 10 of the present invention enables a single worker to open and close heavy manhole covers which have conventionally been opened and closed by a gang of several workers.

Although certain preferred embodiments have been shown and described, it should be understood that many changes and modifications may be made therein without departing from the scope of the appended claims.

What is claimed is:

1. A lifting device for lifting a manhole cover having a hook-receiving hole, comprising:

an elongated lever rod having a load part at one end thereof and a handle on an opposite end thereof, said lever rod comprising an elongated bar having a shallow bend intermediate the ends thereof so that the bar has a shallow upwardly opening V-shaped configuration;

a support member fixed to said bar in the vicinity of said bend and projecting downwardly therefrom, and a roller supported on said support member adjacent the lower end thereof;

said load part of said rod having therein a substantially spherical cavity, said load part also having therein a narrow slot extending longitudinally of said lever rod and in communication with said cavity, said slot opening downwardly through the underside of said rod; and a hook swivelly and pivotally mounted on said load part and depending downwardly therefrom for engagement with the hook hole in the manhole cover;

said hook including an elongated rodlike portion which projects downwardly through said slot and has a sidewardly projecting hook part fixed on the lower end thereof, said rodlike portion also having a ball-shaped portion fixed to the upper end thereof and rotatably retained in said spherical cavity for permitting the hook to both rotate about the longitudinal axis of the rodlike portion and vertically pivot along the longitudinal direction of the lever rod.

2. A lifting device according to claim 1, wherein said hook part has an inverted T-shaped configuration.

* * * * *